US012760544B2

(12) United States Patent
Zeng et al.

(10) Patent No.: US 12,760,544 B2
(45) **Date of Patent: *Oct. 13, 2026**

(54) NON-INFLATABLE ABOVE-GROUND POOL

(71) Applicant: BESTWAY INFLATABLES & MATERIAL CORP., Shanghai (CN)

(72) Inventors: Xianglin Zeng, Shanghai (CN); Yunzhe Ban, Shanghai (CN); Qingshui Song, Shanghai (CN); Chenggen Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 252 days.

This patent is subject to a terminal disclaimer.

(21) Appl. No.: 18/107,064

(22) Filed: Feb. 8, 2023

(65) Prior Publication Data

US 2024/0060321 A1 Feb. 22, 2024

(30) Foreign Application Priority Data

Aug. 16, 2022 (CN) ..... 202222153303.X

(51) Int. Cl.
*E04H 4/12* (2006.01)
*E04H 4/00* (2006.01)
*E04H 4/08* (2006.01)

(52) U.S. Cl.
CPC ..... *E04H 4/1245* (2013.01); *E04H 4/0006* (2013.01); *E04H 4/0043* (2013.01);
(Continued)

(58) Field of Classification Search
CPC ..... E04H 4/1245; E04H 4/129; E04H 4/1218; E04H 4/0006; E04H 4/0043; E04H 4/08;
(Continued)

(56) References Cited

U.S. PATENT DOCUMENTS 5,548,852 A * 8/1996 Rowe ..... E04H 4/0056 4/584
5,799,345 A * 9/1998 Hansen ..... A61H 33/6021 4/584
(Continued)

FOREIGN PATENT DOCUMENTS

CN 200980613 11/2007
CN 203654811 6/2014
(Continued)

OTHER PUBLICATIONS

Notice of Acceptance of Request for Invalidation, dated Jun. 1, 2023 (Jun. 1, 2023), 26 pages, (including English Machine Translation of Request), issued on related Chinese granted patent 202222153303.X, by the China National Intellectual Property Administration.
(Continued)

*Primary Examiner* — Janie M Loeppke
(74) *Attorney, Agent, or Firm* — Dickinson Wright PLLC

(57) ABSTRACT

A non-inflatable above-ground pool is provided, including: a pool bottom and a pool wall connected to an edge of the pool bottom, together defining a water storage cavity. The pool wall comprises an inner wall, an outer wall, and a top sheet. Each of the inner wall and the outer wall have an upper edge connected to the top sheet and a lower edge connected to the pool bottom so as to define a filling chamber. A support wall body is disposed in the filling chamber and includes a wall body opening therethrough. A control box is arranged in the wall body opening and is in fluid communication with the water storage cavity via the inner wall.

19 Claims, 8 Drawing Sheets

(52) U.S. Cl.
CPC ..... *E04H 4/08* (2013.01); *E04H 4/1218* (2013.01); *E04H 4/129* (2013.01)

(58) Field of Classification Search
CPC ..... A61H 33/0087; A61H 33/028; A61H 33/6005; A61H 33/6089
See application file for complete search history.

(56) References Cited

U.S. PATENT DOCUMENTS

| | | | | |
|---|---|---|---|---|
| 6,003,166 | A * | 12/1999 | Hald | A61H 33/6026 4/492 |
| 6,058,521 | A | 5/2000 | O'Brien | |
| 6,357,060 | B2 * | 3/2002 | Gloodt | A47K 3/10 210/764 |
| 7,334,274 | B2 * | 2/2008 | Wang | A61H 33/60 4/541.3 |
| 10,975,587 | B2 * | 4/2021 | Nelson | E04H 4/14 |
| 2007/0245479 | A1 * | 10/2007 | Schroeder | E04H 4/08 4/498 |
| 2008/0141449 | A1 * | 6/2008 | Ren | A61H 33/60 601/154 |
| 2016/0376800 | A1 * | 12/2016 | Zhang | A61H 33/6005 4/513 |
| 2019/0085576 | A1 * | 3/2019 | Lin | A61H 33/0095 |
| 2022/0074219 | A1 * | 3/2022 | Huang | E04H 4/1245 |

FOREIGN PATENT DOCUMENTS

| | | | | |
|---|---|---|---|---|
| CN | 215109703 | | 12/2021 | |
| CN | 215212580 | | 12/2021 | |
| EP | 3078788 | A1 * | 10/2016 | A61H 33/0087 |
| FR | 2682981 | | 4/1993 | |
| WO | 2004029385 | | 4/2004 | |
| WO | WO-2004029385 | A1 * | 4/2004 | E04H 4/0043 |

OTHER PUBLICATIONS

Decision of CNIPA (according to which the patent remained valid), dated Mar. 18, 2024 (Mar. 18, 2024), 17 pages (including English Machine Translation of Decision), issued on related Chinese granted patent 202222153303.X, issued by the China National Intellectual Property Administration.

Extended European Search Report issued Aug. 28, 2023 (Aug. 28, 2023), (10 pages), on related European patent application 23156460.0 by the European Patent Office.

* cited by examiner

NON-INFLATABLE ABOVE-GROUND POOL

CROSS-REFERENCE TO RELATED APPLICATION

This application claims priority from Chinese Application CN202222153303.X, filed Aug. 16, 2022 in China, the disclosure of which is incorporated herein by reference in its entirety.

BACKGROUND

1. Field

Apparatuses and methods consistent with exemplary embodiments relate to a non-inflatable above-ground pool.

2. Description of the Related Art

Pool walls of related art above-ground pools may be inflatable. Such inflatable pool walls have the disadvantages of being easy to expand and deform, which affects the appearance of the pool, makes the pool prone to air leakage, and is complicated to use and manufacture. In addition, a functional inflatable pool is often equipped with a control box including a water pump, a filter, a heater, an air pump and other components. This control box is placed outside the pool body and needs to be in fluid communication with the inside of the pool by means of a pipeline passing through the inflatable pool wall. Thus, the entire pool has a complex structure, is not easy to assemble, occupies a large space, and has a short service life.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an above-ground pool, comprises: a pool bottom; a pool wall connected to an edge of the pool bottom, such that the pool bottom and the pool wall together define a water storage cavity, wherein the pool wall comprises: an inner wall, an outer wall, and a top sheet, wherein each of the inner wall and the outer wall comprise having an upper edge connected to the top sheet and a lower edge connected to the pool bottom, thereby defining a filling chamber; and a support wall body disposed in the filling chamber, the support wall body having a wall body opening formed therein; and a control box disposed in the wall body opening and in fluid communication with the water storage cavity via the inner wall.

The support wall body may comprise a foam material.

The control box may comprise a water pump integrated with a filter and a heater, and the inner wall has a water inlet hole and a water outlet hole formed therethrough, thereby allowing the water pump to be in fluid communication with the water storage cavity.

The above-ground pool may further comprise: a water inlet joint traversing the water inlet hole and connected to the water pump, such that the inner wall is clamped between the water inlet joint and the water pump; and a water outlet joint traversing the water outlet hole and connected to the water pump, such that the inner wall is clamped between the water outlet joint and the water pump.

The control box may comprise an air pump, and the outer wall may have an air inlet hole formed therethrough, and the inner wall may have an air outlet hole formed therethrough, such that the air pump is in fluid communication with the water storage cavity.

The pool bottom may comprise a wave-making channel arranged adjacent to the inner wall and in fluid communication with the water storage cavity, and the above-ground pool may further comprise a connecting channel enabling fluid communication between the air outlet hole and the wave-making channel.

The outer wall may have a panel hole and a cord hole formed therethrough, and the control box may comprise a control panel extending through the panel hole and a power cord extending through the cord hole.

The pool wall may further comprise a connecting sheet comprising an upper edge connected to an outer edge of the top sheet, and a lower edge detachably connected to an upper edge of the outer wall.

The above-ground pool may further comprise a pool cover sized to cover the water storage cavity and detachably connected to the outer wall.

The above-ground pool may further comprise a pool cover liner attached to a bottom of the pool cover.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
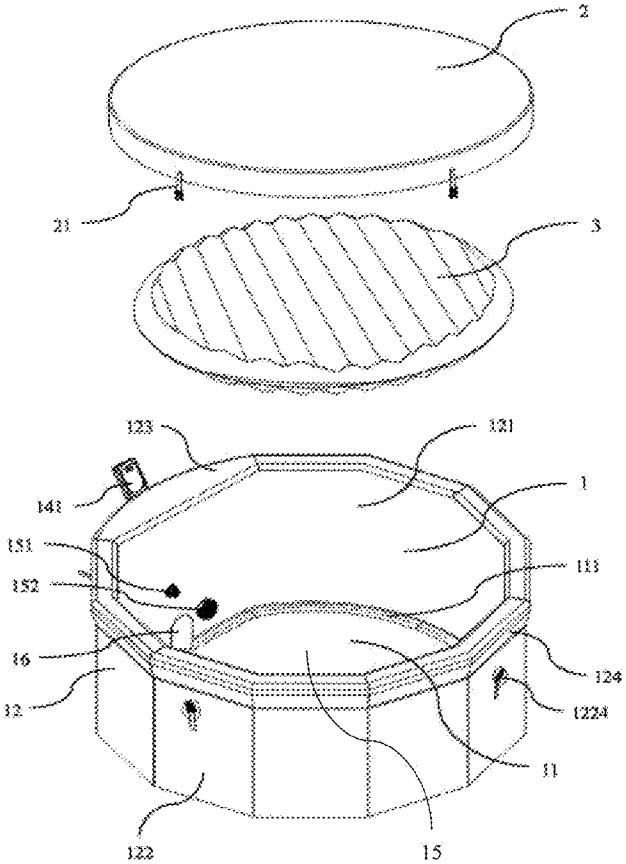
FIG. 1 is a schematic overall structural view of an example embodiment of an above-ground pool.
Figure 2:
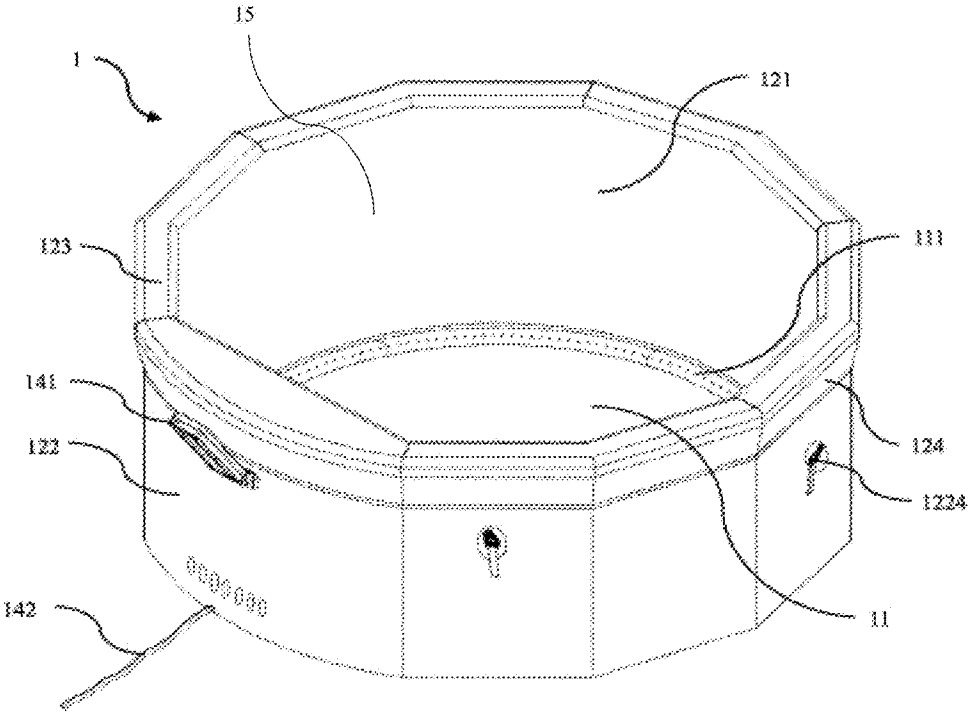
FIG. 2 is a schematic perspective view of a pool body of the above-ground pool of FIG. 1.
Figure 3:
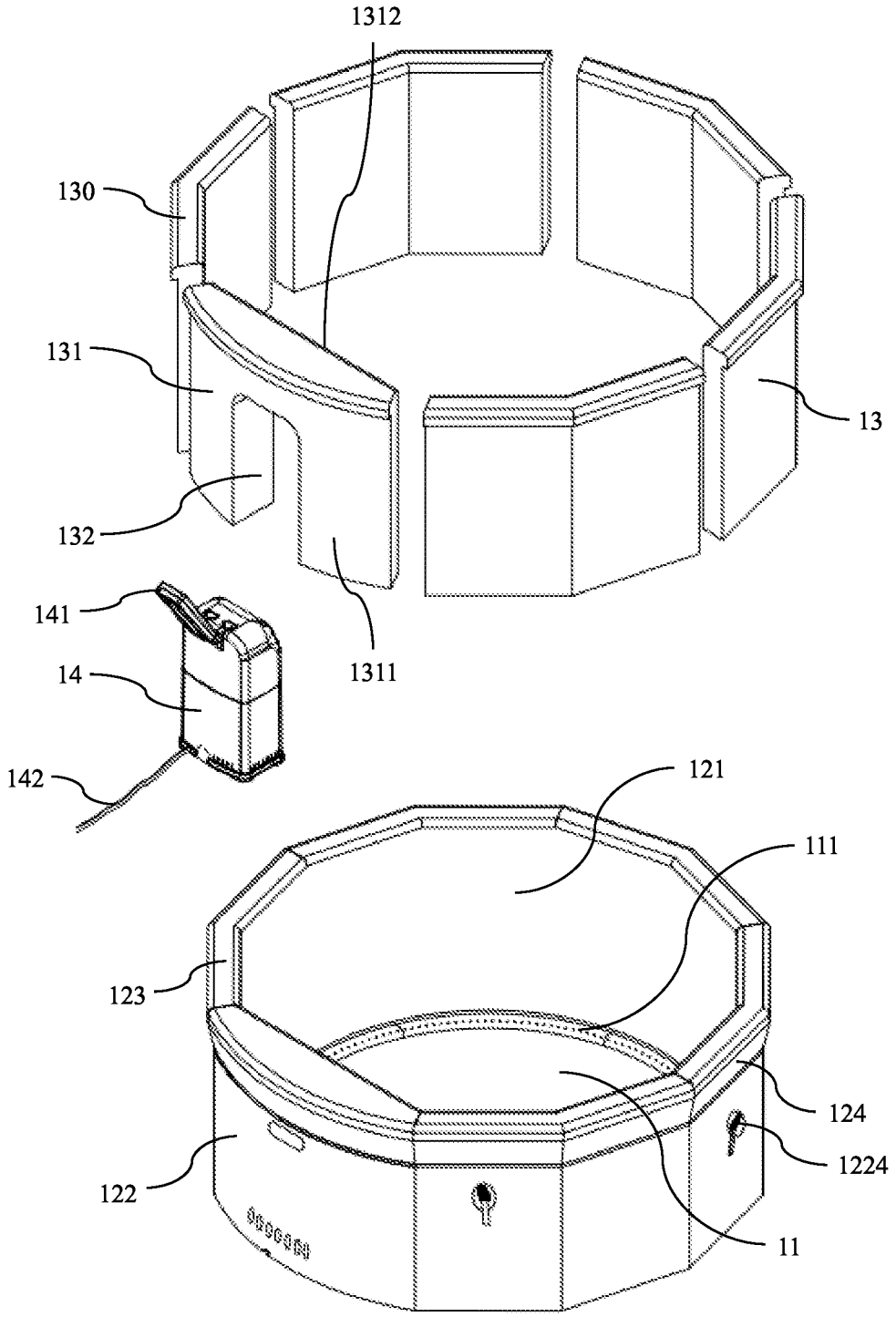
FIG. 3 is a schematic exploded view of the pool body of FIG. 2.
Figure 4:
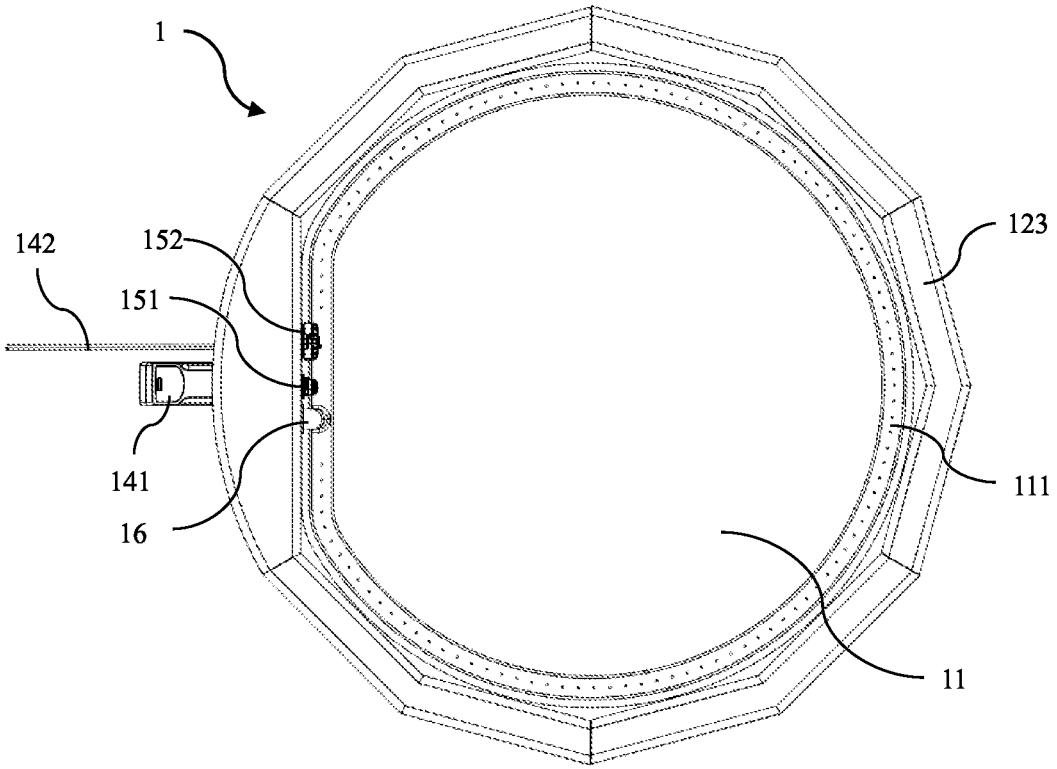
FIG. 4 is a schematic top view of the pool body of FIG. 2.
Figure 5:
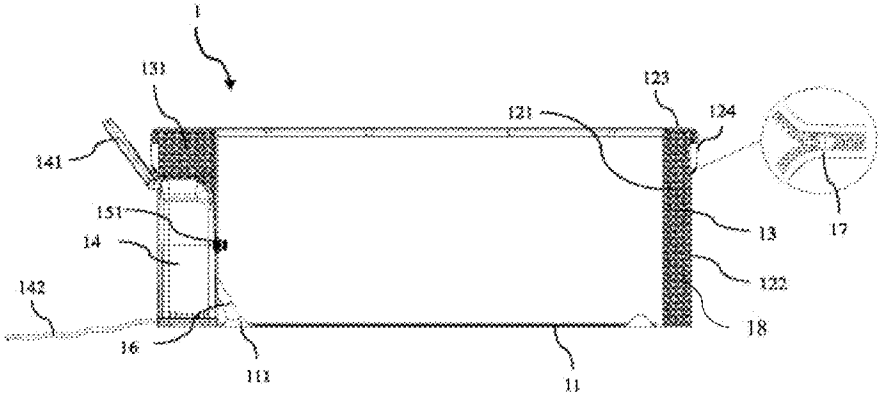
FIG. 5 is a schematic cross-sectional view of the pool body of FIG. 2.
Figure 6:
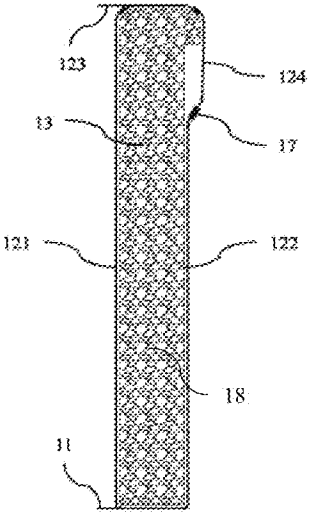
FIG. 6 is a schematic partial enlarged view of a pool wall of the pool body of FIG. 5.
Figure 7:
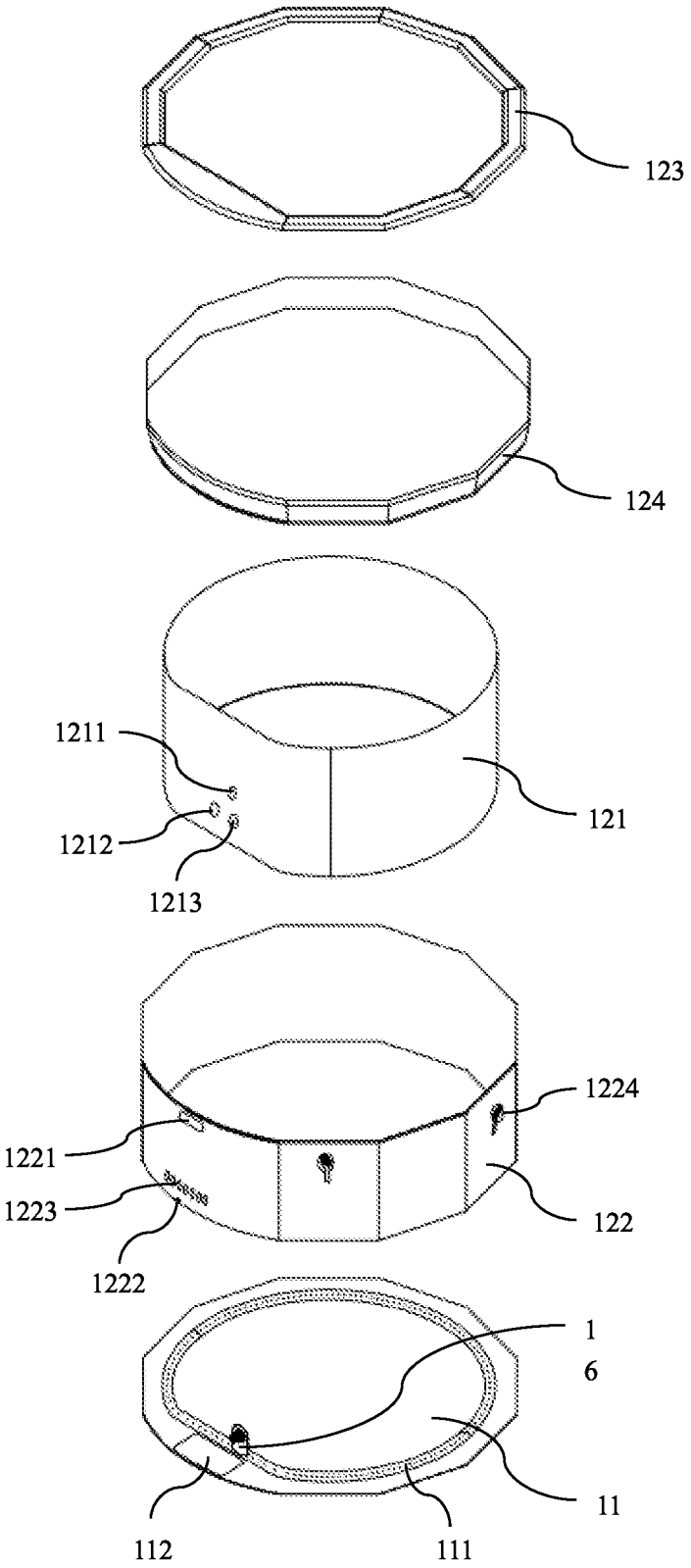
FIG. 7 is a schematic exploded view of a body jacket of the pool body of FIG. 2.
Figure 8:
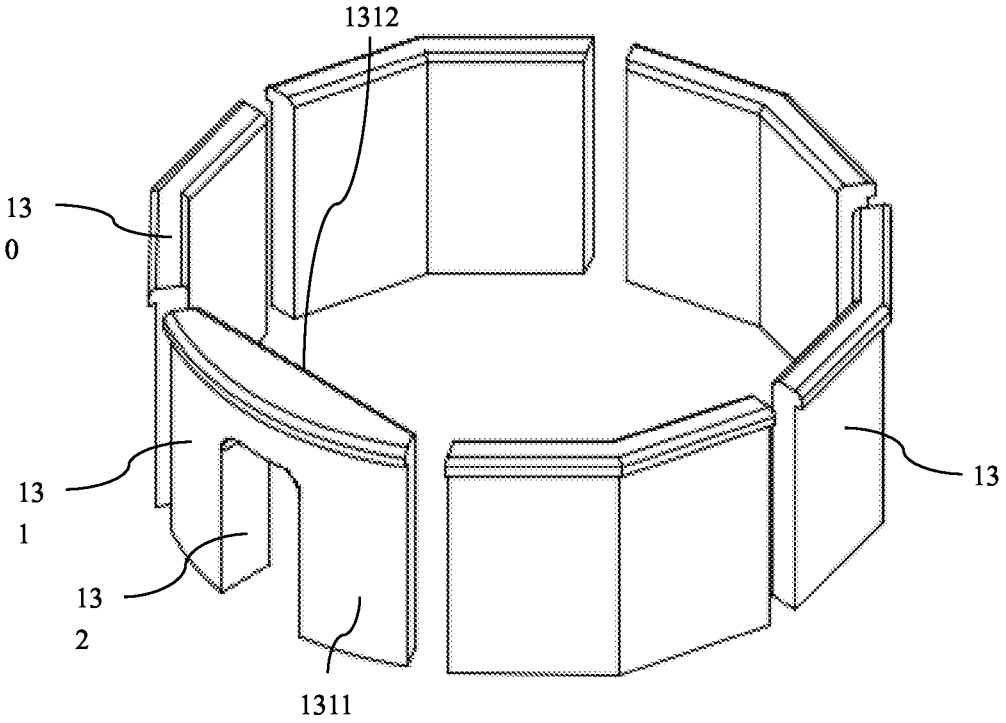
FIG. 8 is a schematic perspective view of a filling material of the pool body of FIG. 2.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

In this description, directional expressions such as "upper", "lower", "top", and "bottom" are not absolute, but relative. The directional expressions are appropriate when various components are arranged as shown in the figures, but should change accordingly when positions of the various components in the figures change. In addition, "inner" and "outer" are defined with reference to the radially inward and outward directions of the above-ground pool as shown.

In this specification, the terms such as "connection" should be construed in a broad sense, unless otherwise expressly specified and limited. For example, the connection may be a fixed connection, a detachable connection, or an integral connection, may be a mechanical connection or an electrical connection, and may be a direct connection, an indirect connection, or an association through a certain function. For those skilled in the art, the specific meaning of the above terms herein would have been understood according to specific circumstances.

An example embodiment of a non-inflatable above-ground pool will be described below with reference to FIGS. 1 to 10.

As shown in FIG. 1, the non-inflatable above-ground pool comprises a pool body 1, a pool cover 2 that may cover the top of the pool body 1, and a pool cover liner 3.

As shown in FIGS. 1 to 7, the pool body 1 comprises a pool bottom 11 and a pool wall 12 that surrounds the pool bottom 11 and is connected to an edge of the pool bottom 11. The pool bottom 11 and the pool wall 12 together define a water storage cavity 15 of the above-ground pool. The pool bottom 11 may have, for example, a multi-layer structure sandwiched with a buffer material such as pearl cotton.

More specifically, the pool wall 12 comprises an inner wall 121, an outer wall 122, a top sheet 123, and a connecting sheet 124. Similar to those of the pool bottom 11, the components of the pool wall 12 may all be made of a polyvinyl chloride (PVC) film material, for example, and form a body jacket together with the pool bottom 11. An upper edge of the inner wall 121 is connected to an inner edge of the top sheet 123 by means of welding, a lower edge of the inner wall 121 is connected to the pool bottom 11 by means of welding, an upper edge of the outer wall 122 is detachably connected to a lower edge of the connecting sheet 124 by means of a connecting component 17 such as a sewed zipper (see the enlarged part in FIG. 5 and FIG. 6), a release buckle, or a hook-and-loop fastener, a lower edge of the outer wall 122 is connected to an outer edge of the pool bottom 11 by means of welding, and an upper edge of the connecting sheet 124 is connected to an outer edge of the top sheet 123 by means of welding. In this way, the inner wall 121, the outer wall 122, the top sheet 123, the connecting sheet 124, and the pool bottom 11 together define a filling chamber 18 for filling the wall body. It can be understood that the connecting sheet 124 is not necessarily provided, and the purpose of providing the connecting sheet is to allow the detachable connecting component 17, such as a zipper, to be arranged on the outer side of the pool wall. In addition, the arrangement of the detachable connecting component on the outer edge of the top sheet of the pool should be avoided, which is convenient for a user to install and remove the wall body As shown in FIGS. 3-6 and FIG. 8, for example, a support wall body 13 made of a foam material, such as polyethylene (PE), polypropylene (PP), polystyrene (PS) or polyethylene terephthalate (PET), is filled in the filling chamber 18 of the pool wall 12, the support wall body 13 is formed, for example, of a plurality of support units spliced in sequence along the circumferential direction, and a top portion 130 of each support unit slightly protrudes outward relative to the rest. One of the support units 131 is thicker than the other support units and is provided with a wall body opening 132. An outer surface 1311 of the support unit 131 is configured to have an arc shape, and an inner surface 1312 thereof is configured to have a flat shape. The wall body opening 132 is shaped and sized to coordinate with the control box, that is, the wall body opening 132 can accommodate the control box therein. With the exception of this support unit 131, the inner and outer surfaces of each of the other support units are each configured to have an inward angled shape, so that the support units are spliced in sequence to form a polygonal support wall body 13. It can be understood that the shape of the support unit is not limited, for example, the inner and outer surfaces of each support unit can be configured to have an inward arc shape, so that the support units are spliced in sequence to form a circular support wall body. Compared with an inflatable pool wall, the non-inflatable assembled pool wall is not easily deformable, is easy to assemble and use, and has good aesthetics.

As shown in FIGS. 1 to 7, the pool body 1 further comprises a control box 14 integrated with a water pump and an air pump. A filter and a heater are integrated in the water pump. The control box 14 is embedded in the wall body opening 132 and is in fluid communication with the water storage cavity 15 via the inner wall 121, so as to allow the above-ground pool to have various functions such as filtering, heating, and wave-making massage.

More specifically, the inner wall 121 is provided with a water inlet hole 1211 and a water outlet hole 1212 that allow the water pump to be in fluid communication with the water storage cavity 15, and the pool body 1 further comprises a water inlet joint 151 and a water outlet joint 152. The water inlet joint 151 passes through the water inlet hole 1211 and is tightly connected to the water pump, for example, by means of screw fitting, and allows the inner wall 121 to be clamped between the water inlet joint 151 and the water pump. The water outlet joint 152 passes through the water outlet hole 1212 and is tightly connected to the water pump, for example, by means of screw fitting, and allows the inner wall 121 to be clamped between the water outlet joint 152 and the water pump. Therefore, the water in the water storage cavity 15 can enter the water pump via the water inlet joint 151, be filtered and heated, and then return to the water storage cavity 15 via the water outlet joint 152.

Figure 9:
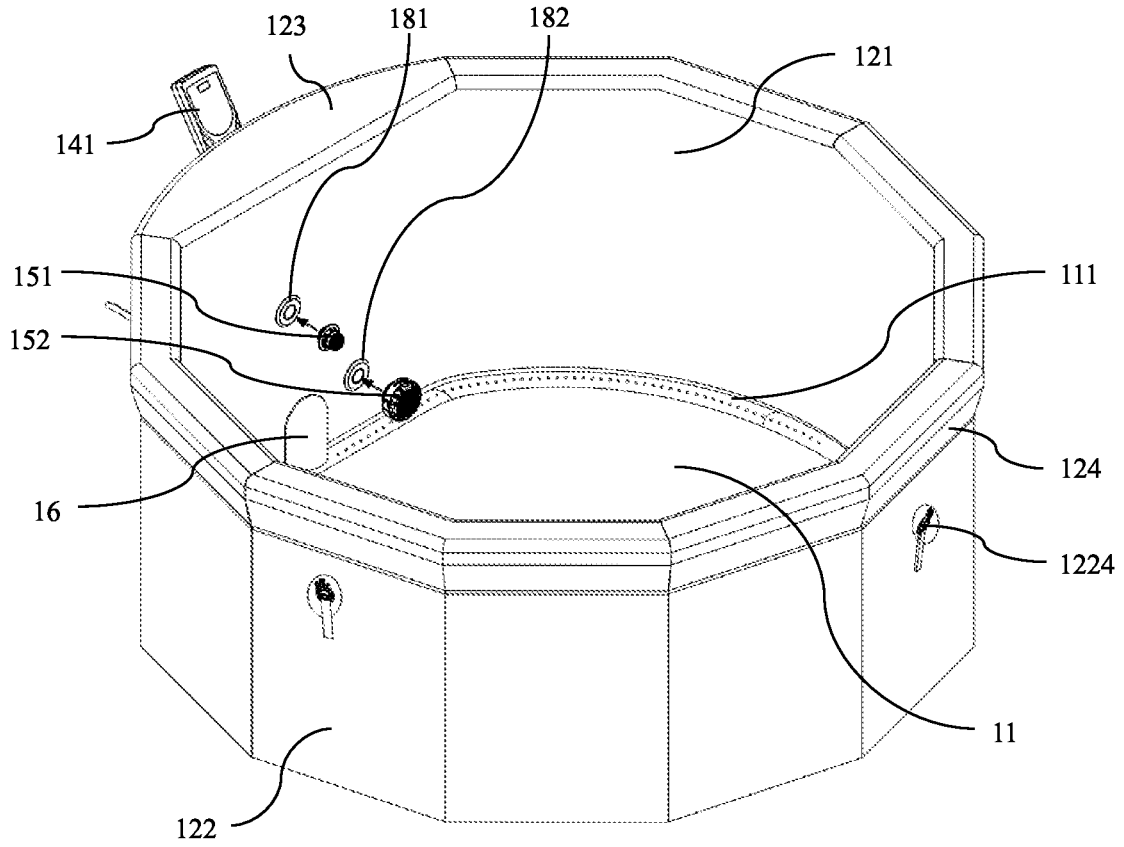
FIG. 9 is a schematic perspective view of an alternate example embodiment of a pool body of an above-ground pool.
Figure 10:
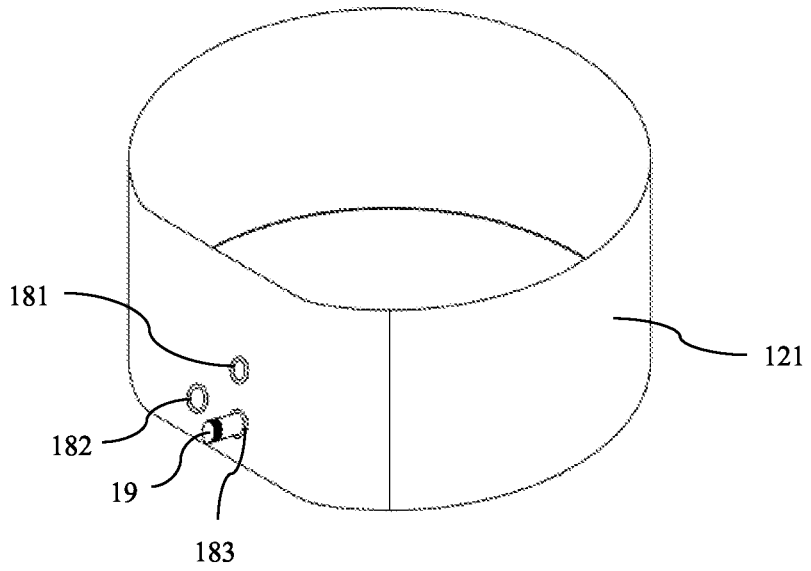
FIG. 10 is a schematic perspective view of an inner wall of the pool body of FIG. 9.

As shown in FIGS. 9 and 10, according to an alternate example embodiment, the pool body 1 may further comprise a first sealing member 181 arranged around the water inlet hole 1211 and between the inner wall 121 and the water inlet joint 151, and a second sealing member 182 arranged around the water outlet hole 1212 and between the inner wall 121 and the water outlet joint 152. Since the water inlet joint 151 and the water outlet joint 152 respectively pass through the water inlet hole 1211 and the water outlet hole 1212 and are then connected to the water pump, these sealing members are provided to ensure the tightness of the inner wall 121 to prevent the water in the water storage cavity 15 from entering the pool wall 12 through the water inlet hole 1211 and the water outlet hole 1212. Optionally, the first sealing member 181 and the second sealing member 182 may be fixedly arranged on the inner wall 121.

In addition, the outer wall 122 is provided with an air inlet hole 1223, and the inner wall 121 is provided with an air outlet hole 1213 that allows the air pump to be in fluid communication with the water storage cavity 15. In this example embodiment, the pool bottom 11 comprises an annular wave-making channel 111, the wave-making channel 111 being arranged adjacent to the inner wall 121 and in fluid communication with the water storage cavity 15 through a plurality of jet holes evenly arranged along the circumferential direction, and the pool body 1 further comprises a connecting channel 16 that allows the air outlet hole 1213 to be in fluid communication with the wave-making channel 111, with one end of the connecting channel 16 being connected to the inner wall 121 around the air outlet hole 1213 by means of welding, and the other end thereof being connected to the wave-making channel 111 by means of welding. In this way, the air entering the air pump through the air inlet hole 1223 can enter the annular wave-making channel 111 through the air outlet hole 1213 and the connecting channel 16, and is then sprayed into the water storage cavity 15 through the jet hole of the wave-making channel 111, so as to provide a comfortable wave-making massage function for a user of the pool. In this example embodiment, the pool bottom 11 is further provided with a pool bottom opening 112. The pool bottom opening 112 is adapted to the bottom of the control box 14, and may not only be used as an auxiliary air inlet, but also used for positioning the control box 14 during assembly of the pool wall 12.

In an example alternative implementation shown in FIG. 10, the pool body 1 may further comprise an air outlet pipe 19 that is tightly connected to the air pump, for example, by means of screw fitting, and the air outlet pipe 19 passes through the air outlet hole 1213 and allows the air pump to be in fluid communication with the connecting channel 16. In addition, the pool body 1 may further comprise a third sealing member 183 arranged around the air outlet hole 1213 and between the inner wall 121 and the air outlet pipe 19.

In addition, the control box 14 comprises a control panel 141 and a power cord 142 that extend from the body of the control box, and the outer wall 122 is provided with a panel hole 1221 for the control panel 141 to pass through and a cord hole 1222 for the power cord 142 to pass through. The control panel 141 protruding from the pool wall 12 through the panel hole 1221 is used by a user to start, stop, or adjust the various functions of the control box 14 mentioned above.

Since the control box 14 is integrated into the pool wall 12 of the pool body 1 rather than placed outside the pool body 1, the pipeline structure of the pool may be simplified without affecting the function of the poor, and the entire pool has a concise appearance and does not occupy additional floor space.

As shown in FIG. 1, the pool cover 2 is used to cover the water storage cavity 15 and is detachably connected to the outer wall 122, so as to provide a thermal insulation effect before a user enters the pool. In this embodiment, the outer edge of the pool cover 2 is provided with a plurality of first inserts 21, and the outer wall 122 is provided with a plurality of second inserts 1224 that may be in insert-fit with the first inserts 21. Of course, this detachable connection manner is not restrictive, and these inserts may also be replaced with zippers, hook-and-loop fasteners and other components.

In addition, the pool cover liner 3 attached to the bottom of the pool cover 2 is shaped and sized to adapt to the water storage cavity 15. The pool cover liner 3 may have an inflatable structure, or may be additionally provided with a thermal insulation layer inside, and thus can be used together with the pool cover 2 to further reduce the heat loss of the above-ground pool.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. An above-ground pool, comprising:

a pool bottom;

a pool wall connected to an edge of the pool bottom to define a water storage cavity within the pool bottom, the pool wall comprising:

an inner wall made of film material and having an upper edge and a lower edge welded to the pool bottom;

an outer wall made of film material and having an upper edge and a lower edge welded to the pool bottom;

a top sheet made of film material and having an outer edge and an inner edge welded to the upper edge of the inner wall;

a connecting sheet having an upper edge welded to the outer edge of the top sheet and a lower edge detachably connected to the upper edge of the outer wall;

a filling chamber defined by the pool bottom, the inner wall, the outer wall, the top sheet, and the connecting sheet in a circumferential direction;

a support wall body disposed in the filling chamber and comprising a plurality of support units arranged along the circumferential direction of the filling chamber, with at least one of the plurality of support units having a wall body opening; and a control box disposed in the wall body opening and in fluid communication with the water storage cavity through the inner wall.

2. The above-ground pool according to claim 1, wherein the support wall body comprises a foam material.

3. The above-ground pool according to claim 1, wherein:

the control box comprises a water pump integrated with a filter and a heater, and the inner wall has a water inlet hole and a water outlet hole formed therethrough, thereby allowing the water pump to be in fluid communication with the water storage cavity.

4. The above-ground pool according to claim 3, further comprising:

a water inlet joint traversing the water inlet hole and connected to the water pump, such that the inner wall is clamped between the water inlet joint and the water pump; and a water outlet joint traversing the water outlet hole and connected to the water pump, such that the inner wall is clamped between the water outlet joint and the water pump.

5. The above-ground pool according to claim 1, wherein:

the control box comprises an air pump, and the outer wall has an air inlet hole formed therethrough, and the inner wall has an air outlet hole formed therethrough, such that the air pump is in fluid communication with the water storage cavity.

6. The above-ground pool according to claim 5, wherein:

the pool bottom comprises a wave-making channel arranged adjacent to the inner wall and in fluid communication with the water storage cavity, and the above-ground pool further comprises a connecting channel enabling fluid communication between the air outlet hole and the wave-making channel.

7. The above-ground pool according to claim 1, wherein:

the outer wall has a panel hole and a cord hole formed therethrough, and the control box comprises a control panel extending through the panel hole and a power cord extending through the cord hole.

8. The above-ground pool according to claim 1, further comprising a pool cover sized to cover the water storage cavity and detachably connected to the outer wall.

9. The above-ground pool according to claim 8, further comprising a pool cover liner attached to a bottom of the pool cover.

10. The above-ground pool according to claim 1, wherein the connecting sheet further comprises a detachable connecting component that detachably connects the lower edge of the connecting sheet to the upper edge of the outer wall.

11. The above-ground pool according to claim 10, wherein the detachable connecting component is a zipper.

12. The above-ground pool according to claim 11, wherein the zipper is sewn to the lower edge of the connecting sheet and to the upper edge of the outer wall.

13. The above-ground pool according to claim 3, further comprising a first sealing member fixedly arranged about the water inlet hole.

14. The above-ground pool according to claim 13, further comprising a second sealing member fixed arranged about the water outlet hole.

15. The above-ground pool according to claim 1, wherein the pool bottom further comprises a pool bottom opening formed adjacent the control box.

16. The above-ground pool according to claim 1, wherein a top portion of each of the plurality of support units protrudes outwardly relative a body of each of the plurality of support units.

17. The above-ground pool according to claim 1, wherein at least one of the plurality of support units has a thickness that is greater than a thickness of each of the other plurality of support units.

18. The above-ground pool according to claim 1, wherein at least one of the plurality of support units defines a wall body opening, an outer surface having an arc shape, and an inner surface having a flat shape.

19. The above-ground pool according to claim 1, wherein an inner surface of each of the plurality of support units and an outer surface of each of the plurality of support units each have an inwardly angled shape, such that the support wall body defined by the plurality of support units has a polygonal shape.

* * * * *